United States Patent [19]

Ferment et al.

[11] 4,288,486

[45] Sep. 8, 1981

[54] FLEXIBLE SHEET-TYPE COVERING MATERIAL AND PROCESS FOR MAKING SAME

[75] Inventors: George R. Ferment, Randolph, N.J.; Douglas C. Woerner, Northampton, Pa.

[73] Assignee: GAF Corporation, New York, N.Y.

[21] Appl. No.: 178,051

[22] Filed: Aug. 14, 1980

Related U.S. Application Data

[62] Division of Ser. No. 36,605, May 7, 1979, Pat. No. 4,242,397.

[51] Int. Cl.[3] ..... B32B 3/26; B05D 3/12

[52] U.S. Cl. ..... 428/141; 427/244; 427/366; 428/159; 428/160; 428/195; 428/210; 428/313; 428/315

[58] Field of Search ..... 427/244, 369, 366; 428/313, 315, 159, 160, 141, 195, 207, 210

[56] References Cited

U.S. PATENT DOCUMENTS 3,607,341 9/1971 Goins et al. ..... 428/315 X

*Primary Examiner*—Evan K. Lawrence

*Attorney, Agent, or Firm*—James Magee, Jr.; Joshua J. Ward

[57] ABSTRACT

Flexible, sheet-type covering material is made by coating a porous mat with mechanically frothed plastic foam. The foam is gelled, at least partially fused and then calendered to crush the foam.

6 Claims, 1 Drawing Figure

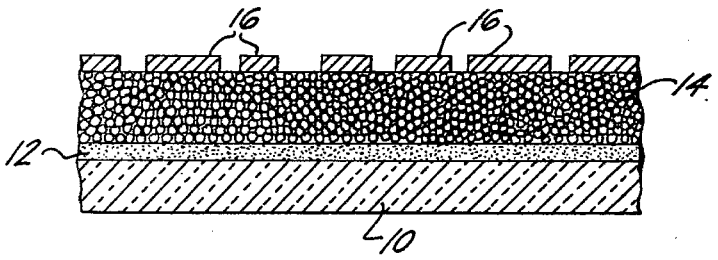
16
16
14
12
10

FLEXIBLE SHEET-TYPE COVERING MATERIAL AND PROCESS FOR MAKING SAME

This application is a division of application Ser. No. 036,605, filed May 7, 1979, U.S. Pat. No. 4,242,397.

BACKGROUND OF THE INVENTION

This invention relates to decorative sheet-type covering material and especially to a method for preparing suitable substrate for such material.

Decorative, flexible sheet-type covering materials such as wall or floor coverings are well-known. Frequently, such coverings involve the use of a chemically blown foamable plastic applied in a liquid state to a substrate. The foamable liquid is then gelled, frequently printed with a design, and expanded by heat to e.g. three times its original thickness. Conventional use of such chemically foamed material is described for instance in U.S. Pat. No. 3,458,337 and U.S. Pat. No. 3,293,094, the disclosures of which are incorporated herein by reference.

While the use of chemically foamed plastic over substrates in the production of sheet covering materials is well-known and has been extensively practiced, the resulting products have not always been entirely satisfactory. Where porous substrates or irregular substrates have been used, results have been less than satisfactory since irregularities in substrate or penetration of the foamable liquid coating into the supporting substrate results in magnified surface distortions in the finished product. This is especially noticeable where printed patterns are formed on the foamed layer or are printed onto an unfoamed layer prior to foaming of the layer.

The use of non-foamable material for sealing and coating a porous or irregular substrate has been generally unsatisfactory due to penetration of the coating material into the openings in the porous substrate.

In addition to chemically foamed plastics of the type mentioned above, mechanically foamed plastics in which air or other gas is introduced into the plastic as by beating or other forms of mechanical aeration are well known, as exemplified for instance in U.S. Pat. No. 3,511,788, the disclosure of which is also incorporated herein by reference. Such mechanically foamed plastics have been suggested for a variety of purposes such as in very thin layers for application to a variety of substrates as suggested in the above-mentioned U.S. Pat. No. 3,511,788. Such foams have also been utilized as backing for sheet covering materials, especially flooring to provide resiliency under foot.

It is also quite common in the flooring industry to make an embossed foam product either by use of chemical means such as suppresent inks, etc., in the manner taught by the above-mentioned U.S. patents or by mechanical embossing of the foamed layer or completed product. Mechanical embossing is a well known technique as exemplified for instance by the more detailed descriptions in U.S. Pat. Nos. 3,345,234, 3,748,151 and 3,887,678.

SUMMARY OF THE INVENTION

It is an object of the present invention or provide decorative, flexible sheet-type covering material which has a substrate comprising a flexible, porous mat covered on at least one side with a layer of fused, mechanically frothed and crushed, flexible foamed thermoplastic vinyl polymer. The porous mat has openings which average between about 1 and about 20 mils in the smallest linear dimension, with at least about 50% of such openings having smallest linear dimensions between about 2 and 10 mils. The foamed thermoplastic prior to crushing has a density between about 0.2 and 1.0 grams per cubic centimeter (g/cc) and has a viscosity as applied to the mat between about 3000 and about 25,000 centipoises (cp). Vinyl chloride polymers and copolymers are preferred.

The process of the invention involves first coating at least one side of a flexible, porous mat of the type described above with a layer of heat curable, mechanically frothed, flexible thermoplastic foam of the type described above. The layer of foam thus applied to the mat is between about 20 and about 150 mils thick. The layer of foamed plastic is gelled and at least partially fused and then calendered at a temperature within the fusion temperature range of the vinyl polymer at a nip pressure between about 2 and about 40 pounds per linear inch to thereby crush and consolidate the foam so that no reexpansion of the foam occurs after crushing.

BRIEF DESCRIPTION OF DRAWING

The FIGURE is a fragmentary sectional view through a preferred floor covering material of the invention. In this view, it is not intended that the thicknesses of the various layers of the product shown are precisely represented. Rather, the various layers are represented on a considerably large scale without showing precise relationships between thicknesses of the layers.

DETAILED DESCRIPTION OF THE INVENTION

As mentioned above, the product of the invention is decorative flexible, sheet-type covering material comprising a flexible, porous mat coated on at least one side with a layer of mechanically frothed and crushed heat cured (fused) foamed thermoplastic vinyl polymer. While the invention is applicable to porous mats made from any flexible material, the preferred material is glass fibers in woven or non-woven form with non-woven glass fiber mats being especially preferred. The mats to which the invention is applicable are those which are sufficiently porous so that ordinary plastisol or organosol sealing materials penetrate the openings of the mat, thereby making it difficult or impossible to obtain a smooth coating of plastic on the mat. Mats suitable for use in the present invention are those in which the openings in the mat average between about 1 and about 20 mils in the smallest linear dimension with at least about 50% of such openings having smallest linear dimensions between about 2 and about 10 mils. Preferred mats include those having a thickness between about 10 and about 40 mils and a density between about 0.5 and about 4 lbs. per 100 square feet. Such mats may be manufactured by conventional techniques used for manufacturing non-woven glass mats with the glass fibers used preferably having an average diameter between about 5 and about 20 microns, more preferably between about 7 and 15 microns, and fiber lengths between about 0.2 and about 1.5 inch. Binders conventionally used for coating glass fibers may be used and where used are normally present in amounts between about 1 and about 50 wt% of the mat. Suitable binders for coating glass fibers of the mats used in the invention include, for instance, ureaformaldehyde, latexes, thermosetting resins such as polyester resins, epoxy resins and the like and may include, among other conventional binders, those mentioned in U.S. Pat. No. 3,554,851 to Modigliani, the disclosure of which is incorporated herein by reference. The binder may, of course, be applied to the glass fibers in a conventional manner.

As mentioned, the crushed foamed layer comprises thermoplastic vinyl polymer with vinyl chloride polymers and copolymers being especially preferred. Vinyl polymers suitable for use in the invention include a wide variety of vinyl materials such as those described in the above-mentioned U.S. Pat. No. 3,511,788 as well as those conventional polyvinyl chloride (PVC) materials known in the art for use in chemically foamed materials, including for instance those described in the above-mentioned U.S. Pat. Nos. 3,458,337 and 3,293,094. Similar vinyl polymers in latex form are also suitable. Mechanically foamed PVC plastisols and organosols are the preferred materials for the crushed foamed layer of the product of the invention.

The mechanically frothed and crushed foam layers of the invention provide smoother surfaces on porous substrantes than either the previously used chemically foamed plastics or mechanically foamed plastics applied and cured without crushing. Crushed foam layers of the invention are also more suitable for this purpose than the relatively low density crushed foams which are conventionally used as backing for draperies and upholstery fabrics in the textile industry.

As mentioned, the current invention relates to flexible sheet-type covering material suitable for covering walls and floors. In order to achieve the necessary flexibility in the finished product it is necessary that the substrate as well as the crushed cured mechanically frothed foam layer and other optional layers of the invention be flexible rather than rigid. Plastic materials are considered sufficiently flexible for this purpose when, in the form of a foamed and cured unreinforced $\frac{1}{4}''$ foam sheet, they can be bent 180° around a 1″ mandrell without permanent set. Such materials are generally known to those skilled in the flooring and textile industries as are the various types of substrates and their materials which are suitable for use in making flexible decorative wall or floor covering materials.

While flexible porous mats of the invention having a layer of mechanically frothed and crushed, heat cured flexible plastic foam thereon may for some purposes be suitable as substrates for sheet-type covering material without further treatment, it is in many cases desirable to apply to the crushed foam layer a conventional sealing coat of suitable material such as PVC plastisol or organosol. In accordance with a particularly preferred embodiment of the invention, the layer of mechanically frothed and crushed flexible plastic foam is further covered with a conventional layer of foamed plastic such as foamed PVC plastisol or organosol. This provides desired resiliency to the finished product. It will be understood that additional foamed or unfoamed layers of conventional materials for use in flooring, e.g. PVC plastisols or organosols as well as layers of printing or other decorative effects may also be used, all in a conventional manner. Conventional vinyl wear layers for optional use on products on the invention may, for instance, comprise any of the PVC resin materials normally used in connection with the manufacture of sheet vinyl flooring and may specifically include but are not limited to those described in the above-mentioned U.S. Pat. No. 3,458,337. Where used, such vinyl wear layers are typically on the order of between 5 and 25 mils thick for flooring materials and may be opaque, translucent or transparent as desired. Other layers of sealer, pigmented layers, plastisols, wear layers, etc., known in the art may also be used.

PVC plastisol or organosol used in forming the optional foamed layer of the product of the invention described above may be any of the conventional PVC materials known in the art for use as foamed layers on flooring materials and include for instance those described in the above-mentioned U.S. Pat. Nos. 3,458,337 and 3,293,094. The foaming or blowing agent incorporated in the optional foamable plastisol may also be a conventional blowing agent or catalyst-activated blowing agent such as are well known in the art for producing foamed plastisols or organosols. Suitable blowing agents include, for instance, azodicarbonamide (ABFA) and other conventional blowing agents such as those enumerated in the above-mentioned U.S. Pat. No. 3,293,094.

While a wide variety of plastic foam materials are suitable for use in the mechanically frothed and crushed, heat cured foamed thermoplastic layer of the invention, selection of a particular plastic for a given application preferably takes into account such factors as the nature of the porous mat to be coated, the desired viscosity of the foam material as applied to the mat, the viscosity of the foamed plastic as applied, the particle size of PVC resin, degree of solvation of the plastisol, etc.

While the viscosity of foamed thermoplastics utilized in making products of the invention by the process of the invention may vary widely depending upon the type of mat and coating and crushing conditions used, preferred viscosity of the foam as applied to the mat is between about 3,000 and about 25,000 centipoises (cp) as measured on a Brookfield RVF viscosimeter with a TA T-bar spindle at 4 RPM.

As mentioned above, the process of the invention involves first coating at least one side of a flexible, porous mat with a layer of mechanically frothed, flexible foamed thermoplastic between about 10 and about 150 mils thick, then gelling and at least partially fusing the layer of foamed plastic and then calendering the foamed layer to crush the foam. The porous mat and foamed plastic used are those described above with respect to the product of the invention.

While coating of the flexible porous mat with mechanically foamed plastic in accordance with the invention is frequently carried out at room temperature, this is by no means critical and coating temperatures between about 50° and 150° F. are suitable with many of the commonly used plastics.

After the mat is coated with the foamed plastic, the plastic is then gelled and at least partially fused in a conventional manner. Specific time and temperature conditions appropriate for gelling and fusing vinyl polymers are well-known in the art. For many conventional PVC plastisol and organosol foams, gelling involves exposure to temperatures between about 200° and 275° F. for times between about 2 and about 10 minutes and fusion involves subsequent exposure to temperatures between about 275° F. and 425° F. and times between about 1 and about 10 minutes. Normally, when either partial or complete fusion is desired, the foam is not gelled in a separate step, but is instead heated at fusion temperatures for the period of time required to achieve the desired degree of fusion. Following gelling and fusion of the foamed plastic layer, the process of the invention then calls for calendering the foamed plastic layer using a nip pressure between about 2 and about 40 pounds per linear inch (pli) while the temperature of the plastic is in the fusion temperature range to crush the foam. The calendering simultaneously and effectively collapses the foam cells and consolidates the plastic so that no re-expansion occurs after crushing. The vinyl polymer is preferably completely fused upon completion of the calendering operation but fusion can be completed in a separate heating step if desired.

The calendering operation may be carried out using conventional calendering equipment such as a chrome drum, either heated or unheated, with a rubber backing roll. The calendering operation appears to redistribute the foam coating along the surface of the porous substrate mat causing the crushed foam to bridge gaps between fibers and fill depressions between fiber agglomerates. Unfoamed coatings in contrast penetrate into the fiber matrix and assume the contour of the mat even at relatively high viscosity. Calendering of mechanically gelled and partially frothed foam in accordance with the invention produces an exceptionally smooth surface which is suitable for receiving printed designs. Even where additional resiliency is desired and an additional optional foam layer is utilized as mentioned above, the surface of the resulting product is exceptionally smooth and is in fact smoother than can be obtained by merely coating mechanically frothed foam onto a porous substrate.

Coating of the mechanically frothed foam plastic onto the porous substrate in accordance with the invention may be accomplished by any suitable means such as, knife coating or extrusion. The following example is intended to illustrate a preferred embodiment of the invention without limiting the scope of the invention.

For a further understanding of the invention, reference may be had to the accompanying drawing in which floor covering material is shown having a porous mat substrate 10 with a layer 12 of mechanically frothed and crushed, heat cured, flexible, foamed, thermoplastic vinyl polymer adhered thereto. The floor covering shown in the drawing also includes a layer 14 of foamed plastic material adhered to the layer 12. The layer 14 has a decorative pattern 16 applied to the surface thereof.

EXAMPLE

A simulated floor covering material of the invention was prepared by applying approximately 45 mils of mechanically frothed PVC organosol foam to one face of a non-woven fiberglass mat approximately 18 mils thick and weighing 1.0 lb/100 ft$^2$, heating the coated mat in an oven at 355° F. for 1½ minutes to gel and partially fuse the organosol, and then calendering between an unheated polished steel roll and a rubber roll to crush the foam. The foam as coated onto the mat had a density of 0.47 g/cc and a viscosity of 9300 cp. The composition of the organosol was as follows:

| | Parts by Weight |
|---|---|
| PVC-polyvinyl acetate copolymer resin | 40 |
| PVC homopolymer suspension resin | 60 |
| Plasticizer | 75 |
| Diluent | 5 |
| Stabilizer | 1. |
| Filler | 17.5 |

-continued

| | Parts by Weight |
|---|---|
| Silicone Surfactant | 4. |

After calendering, foamable PVC organosol was coated onto the crushed foam surface with a coating bar and gelled in an oven at 275° F. Non-foamable PVC organosol was then coated onto the gelled foamable organosol in the same manner and the sheet was placed in an oven at 355° F. for 2½ minutes to cure the non-foamable organosol and expand and cure the foamable organosol. The decorative printed layer normally included in this type of construction was omitted; however, the sample sheet was identical to a conventional rotogravure cushion sheet vinyl floor covering in all other respects. This sheet was free of blisters, craters, and pinholes and had the smooth surface finish normally desired in a floor covering material. The irregular, highly textured surface of the fiberglass mat was completely masked by the crushed foam intermediate layer, and, as a result was not reflected in the sample sheet surface.

The glass mat used in this example was made up of glass fibers having an average diameter of about 9 microns and an average length of about 0.75". The fibers were coated with urea-formaldehyde binder with the binder making up about 15 wt% of the mat. The openings in the porous mat has smallest linear dimensions averaging about 5 mils with almost all of such openings having smallest linear dimensions between about 2 and about 10 mils.

When product of the invention is manufactured according to the process of the invention, the upper surface of the layer of cured, mechanically frothed and crushed plastic will frequently be found to have height variations less than about 1 mil and to be exceptionally suitable for application of decorative designs with or without the use of the optional layer of chemically foamed plastic.

While the invention has been described with respect to certain embodiments thereof, it will be apparent to those skilled in the art that various changes and modifications may be made without departing from the spirit or scope of the invention.

What is claimed is:

1. Process for making decorative, flexible sheet type covering material comprising the steps of:

(a) coating at least one side of a flexible porous mat with a layer between about 10 and about 150 mils thick of mechanically frothed flexible foamed thermoplastic vinyl polymer;

(b) gelling and at least partially fusing the foamed layer; and (c) then calendering the foamed layer at a temperature within the fusion temperature range of the vinyl polymer and at a nip pressure between about 2 and about 40 pounds per linear inch to thereby crush and consolidate the foamed thermoplastic vinyl polymer so that no re-expansion of the foam occurs after crushing; wherein (i) said mat has openings which average between about 2 and about 20 mils in the smallest linear dimension with at least about 50% of such openings having smallest linear dimensions between about 2 and about 10 mils; and (ii) the foam as applied to the mat has a viscosity between about 3000 and about 25,000 cp.

2. Process according to claim 1 wherein the porous mat is a non-woven mat of glass fibers having average diameters between about 5 and about 20 microns and average lengths between about 0.2 and about 1.5 inch and the mat is between about 10 and about 40 mils thick and has a density between about 0.5 and about 4 lb/100 $ft^2$.

3. Process according to claim 1 wherein the vinyl polymer is completely fused upon completion of the calendering.

4. Process according to claim 3 which also includes the steps of:

(a) covering the layer of crushed cured foam with a layer of foamable plastic;

(b) then gelling the foamable plastic without curing or foaming same;

(c) then printing a decorative pattern on the jelled foamable plastic layer; and (d) then foaming the foamable plastic layer.

5. Process according to claim 1 wherein the plastic is polyvinyl chloride plastisol or organosol.

6. Product produced according to the process of claim 4.

* * * * *